US009291407B2

(12) United States Patent
Huazhao et al.

(10) Patent No.: US 9,291,407 B2
(45) Date of Patent: Mar. 22, 2016

(54) MULTI-CHANNEL HEAT EXCHANGER WITH IMPROVED UNIFORMITY OF REFRIGERANT FLUID DISTRIBUTION

(75) Inventors: Liu Huazhao, Zhejiang (CN); Jiang Jianlong, Zhejiang (CN); Lin-Jie Huang, East Amherst, NY (US)

(73) Assignees: Sanhua (Hangzhou) Micro Channel Heat Exchanger Co., Zhejiang Province (CN); Danfoss A/S, Nordborg (DK)

( * ) Notice: Subject to any disclaimer, the term of this patent is extended or adjusted under 35 U.S.C. 154(b) by 914 days.

(21) Appl. No.: 12/535,504

(22) Filed: Aug. 4, 2009

(65) Prior Publication Data

US 2011/0017438 A1 Jan. 27, 2011

(30) Foreign Application Priority Data

Jul. 23, 2009 (CN) ..... 2009 1 0159926

(51) Int. Cl.
*F28F 9/02* (2006.01)
*F28D 7/06* (2006.01)
(Continued)

(52) U.S. Cl.
CPC ..... *F28F 9/0273* (2013.01); *F25B 39/028* (2013.01); *F28D 1/05316* (2013.01); *F28D 1/05383* (2013.01); *F28D 1/05391* (2013.01); *F25B 2500/01* (2013.01);
(Continued)

(58) Field of Classification Search
CPC ..... F28F 9/026; F28F 9/027; F28F 9/073; F28D 1/0246; F28D 1/0535; F28D 3/04; F28D 1/0408; F28D 1/0417; F28D 1/0426; F28D 1/0443
USPC ..... 165/174, 176, 173; 239/566–568
See application file for complete search history.

(56) References Cited

U.S. PATENT DOCUMENTS 528,144 A * 10/1894 Cadwell ..... 239/543
1,684,083 A * 9/1928 Bloom ..... 62/525
(Continued)

FOREIGN PATENT DOCUMENTS

CN 1673651 A 9/2005
JP H06159969 A 6/1994
(Continued)

OTHER PUBLICATIONS

European Search Report for Application EP09013700 dated Jan. 8, 2014.

*Primary Examiner* — Allen Flanigan
*Assistant Examiner* — Jason Thompson
(74) *Attorney, Agent, or Firm* — McCormick, Paulding & Huber LLP

(57) ABSTRACT

A micro-channel heat exchanger includes an inlet manifold fluidly connected with an outlet manifold by a plurality of generally parallel tubes, further defining a plurality of generally parallel micro-channels therethrough. Refrigerant is introduced to the heat exchanger through a distributor tube disposed within the inlet manifold. The distributor tube includes a plurality of non-circular openings disposed along the length thereof which act as an outlet for refrigerant flow into the inlet manifold and eventually into and through the tubes and micro-channels. The openings are preferably slots arranged along the length of the distributor tube at an angle relative to the longitudinal direction of the distributor tube and oriented within the inlet manifold for a general direction of refrigerant flow at an angle relative to the general direction of refrigerant flow through the tubes. Alternative shapes for the openings are also considered.

18 Claims, 4 Drawing Sheets

(51) Int. Cl.
*F25B 39/02* (2006.01)
*F28D 1/053* (2006.01)
*F28D 21/00* (2006.01)

(52) U.S. Cl.
CPC .. *F28D 2021/007* (2013.01); *F28D 2021/0071* (2013.01); *F28D 2021/0073* (2013.01); *F28D 2021/0084* (2013.01); *F28D 2021/0085* (2013.01); *F28F 2260/02* (2013.01)

(56) References Cited

U.S. PATENT DOCUMENTS

| | | | | | |
|---|---|---|---|---|---|
| 1,966,572 | A | * | 7/1934 | Webb | 239/553 |
| 2,759,248 | A | | 8/1956 | Burgess | |
| 3,976,128 | A | * | 8/1976 | Patel et al. | 165/153 |
| 4,524,823 | A | | 6/1985 | Hummel et al. | |
| 4,557,324 | A | | 12/1985 | Kondo et al. | |
| 5,099,576 | A | * | 3/1992 | Shinmura | 29/890.049 |
| 5,417,280 | A | * | 5/1995 | Hayashi et al. | 165/153 |
| 5,910,167 | A | * | 6/1999 | Reinke et al. | 62/525 |
| 6,016,658 | A | * | 1/2000 | Willis et al. | 60/737 |
| 6,158,503 | A | | 12/2000 | Gille et al. | |
| 6,729,386 | B1 | * | 5/2004 | Sather | 165/110 |
| 6,814,136 | B2 | * | 11/2004 | Yi et al. | 165/153 |
| 6,993,838 | B1 | * | 2/2006 | Staffa et al. | 29/890.052 |
| 7,143,605 | B2 | * | 12/2006 | Rohrer et al. | 62/515 |
| 7,921,558 | B2 | * | 4/2011 | Beamer et al. | 29/890.043 |
| 8,113,270 | B2 | * | 2/2012 | Rios et al. | 165/287 |
| 2004/0026072 | A1 | | 2/2004 | Yi et al. | |
| 2005/0132744 | A1 | | 6/2005 | Rohrer et al. | |
| 2007/0256821 | A1 | * | 11/2007 | Mashiko et al. | 165/160 |
| 2008/0023185 | A1 | * | 1/2008 | Beamer et al. | 165/174 |
| 2008/0078541 | A1 | * | 4/2008 | Beamer et al. | 165/174 |
| 2008/0093051 | A1 | | 4/2008 | Rios et al. | |
| 2010/0089559 | A1 | * | 4/2010 | Gorbounov et al. | 165/174 |
| 2011/0203780 | A1 | * | 8/2011 | Jiang et al. | 165/173 |

FOREIGN PATENT DOCUMENTS

| | | | | | |
|---|---|---|---|---|---|
| JP | H09166368 | A | | 6/1997 | |
| JP | 10-267586 | A | | 10/1998 | |
| JP | 2004278935 | A | | 10/2004 | |
| WO | 2008048251 | A2 | | 4/2008 | |
| WO | 2008048505 | A2 | | 4/2008 | |
| WO | WO2008/048251 | A2 | | 4/2008 | |
| WO | 2008060270 | A1 | | 5/2008 | |
| WO | WO 2008/060270 | | * | 5/2008 | F28F 9/22 |

* cited by examiner

MULTI-CHANNEL HEAT EXCHANGER WITH IMPROVED UNIFORMITY OF REFRIGERANT FLUID DISTRIBUTION

CROSS REFERENCE TO RELATED APPLICATIONS

This application is entitled to the benefit of and incorporates by reference essential subject matter disclosed in Chinese Patent Application No. 200910159926.4 filed on Jul. 23, 2009.

FIELD OF THE INVENTION

The present invention generally relates to heat exchangers, and more particularly relates to micro-channel heat exchangers for evaporators, condensers, gas coolers or heat pumps wherein fluid is uniformly distributed through the micro-channels of the heat exchanger.

BACKGROUND OF THE INVENTION

Micro-channel heat exchangers, also known as flat-tube or parallel flow heat exchangers, are well known in the art, especially for automobile air conditioning systems. Such heat exchangers typically comprise an inlet manifold fluidly connected with an outlet manifold by a plurality of parallel tubes, each tube being formed to include a plurality of micro-channels. In conventional use, an airflow is passed over the surface of the heat exchanger and a refrigerant fluid is passed through the tubes and micro-channels of the heat exchanger to absorb heat from the airflow. During this heat exchange, the refrigerant fluid evaporates, while the temperature of the external airflow is lowered to levels suitable for cooling applications, such as in air conditioning units, coolers or freezers.

During operation, a refrigerant fluid flow is distributed through the inlet manifold so that each tube receives a portion of the total refrigerant fluid flow. Ideally, the fluid flow should be uniformly distributed to each of the tubes, and further each of the micro-channels therein, so as to ensure optimal efficiency in operation of the heat exchanger. However, a bi-phase refrigerant condition often exists between the inlet manifold of the heat exchanger and the tubes and micro-channels in parallel flow heat exchanger designs. That is, a two-phase fluid enters the inlet manifold of the heat exchanger and certain tubes receive more liquid-phase fluid flow while other tubes receive more gas-phase fluid flow, resulting in a stratified gas-liquid flow through the heat exchanger. This bi-phase phenomenon results in an uneven distribution of the refrigerant through the tubes and micro-channels. This, in turn, results in a significant reduction in the efficiency of the heat exchanger. Additionally, some tubes may receive more fluid flow in general than other tubes, which maldistribution also acts to hinder the efficiency of the system.

Various designs for improving the uniformity of refrigerant fluid distribution through a micro-channel heat exchanger have been developed. For example, U.S. Pat. No. 7,143,605 describes positioning a distributor tube within the inlet manifold, wherein the distributor tube comprises a plurality of substantially circular orifices disposed along the length of the distributor tube and positioned in a non-facing relationship with the inlets of respective microchannels in an effect to distribute substantially equal amounts of refrigerant to each of a plurality of flat tubes. Similarly, WO 2008/048251 describes the use of an insert inside the inlet manifold to reduce the internal volume of the inlet manifold. The insert may be a tube-in-tube design, comprising a distributor tube with a plurality of circular openings disposed along the length of the distributor tube for delivering refrigerant fluid to exchanger tubes. These designs, though showing some improvement in refrigerant distribution uniformity, still do not achieve desirable distribution uniformity and performance levels for micro-channel heat exchangers.

FIG. 1 illustrates the change in refrigerant distribution along the length of a standard distributor tube commonly used in micro-channel heat exchangers. In FIG. 1, the straight line represents an ideal distribution condition where a refrigerant fluid is evenly distributed—i.e., the refrigerant mass flow does not vary along the length of the distributor tube. The curved line in FIG. 1 represents the actual condition of refrigerant distribution. Where the curve lies below the straight line, the actual refrigerant distribution is less than ideal. Where the curve is above the straight line, the actual refrigerant distribution is too high. The actual condition curve indicates that tubes in the center of the heat exchanger receive greater fluid flow, while tubes located on the edges of the heat exchanger receive less fluid flow. The shadowed area between the two lines indicates the difference between the actual condition and the ideal condition for refrigerant distribution. The distribution uniformity for the distributor tube can be expressed by the following equation:

$$U=(m_{total}-\Sigma|\Delta m|)/m_{total}$$

where U represents the distribution uniformity of the refrigerant; $m_{total}$ represent the total amount of refrigerant flow; and $\Delta m$ represents the difference between the actual amount of refrigerant flow and the ideal amount of refrigerant flow.

In view of the foregoing, there is a need for a heat exchanger design that increases uniformity of refrigerant fluid distribution and consequently increases performance levels for micro-channel heat exchangers. Accordingly, it is a general object of the present invention to provide a micro-channel heat exchanger design that overcomes the problems and drawbacks associated with refrigerant fluid flow in such parallel flow heat exchanger designs, and therefore significantly improves the uniformity of fluid distribution and overall operational efficiency.

SUMMARY OF THE INVENTION

In one aspect of the present invention, a distributor tube for use in a micro-channel heat exchanger comprises a first open end for communication with a refrigerant source, an opposing second closed end, and a plurality of non-circular openings disposed along the length of the distributor tube between the first end and the second end. The distributor tube is especially adapted for use in a heat exchanger having an inlet manifold fluidly connected to an outlet manifold by a plurality of generally parallel tubes. The distributor tube is especially adapted for use in a micro-channel heat exchanger where each of a plurality of tubes connected between an inlet manifold and an outlet manifold defines a plurality of general parallel micro-channels.

The non-circular openings are preferably slots disposed along the length of the distributor tube. The slots may be arranged on the distributor tube so that the longitudinal direction of each slot is angular arranged relative to the longitudinal direction of the distributor tube. Preferably, adjacent slots are angularly arranged relative to the longitudinal direction of the distributor tube in opposing directions.

In another aspect of the present invention, a micro-channel heat exchanger comprises an inlet manifold and an outlet manifold spaced a predetermined distance therefrom. A plurality of tubes having opposing ends connected with the inlet manifold and the outlet manifold, respectively, to fluidly connected the inlet manifold and the outlet manifold. Each tube includes a plurality of generally parallel micro-channels formed therein. A distributor tube is disposed within the inlet manifold and having a first open end adapted to be connected to a refrigerant source and an opposing closed end. The distributor tube also includes a plurality of non-circular openings disposed along the length of the distributor tube.

The plurality of non-circular openings may be arranged in a substantially linear row along the length of the distributor tube, where the row of openings is oriented within the inlet manifold so that the general direction of refrigerant flow out of the openings is at an angle relative to the general direction of refrigerant flow through the tubes. Alternatively, the distributor tube may comprise two substantially linear rows of non-circular openings along the length of the distributor tube wherein each row of openings is oriented within the inlet manifold so that the refrigerant flow out of the respective openings is angularly disposed relative to the general direction of refrigerant flow through the tubes.

The present invention has adaptability to a variety of uses, including for evaporators, condensers, gas coolers or heat pumps. The present invention has particular utility in air conditioning units for automotive, residential, and light commercial applications. Additionally, the present invention has utility in freezers and conversely heat pump outdoor coils for heating uses.

These and other features of the present invention are described with reference to the drawings of preferred embodiments of a micro-channel heat exchanger and a distributor tube for use therewith. The illustrated embodiments of features of the present invention are intended to illustrate, but not limit the invention.

DETAILED DESCRIPTION OF PREFERRED EMBODIMENTS OF THE INVENTION

Figure 2:
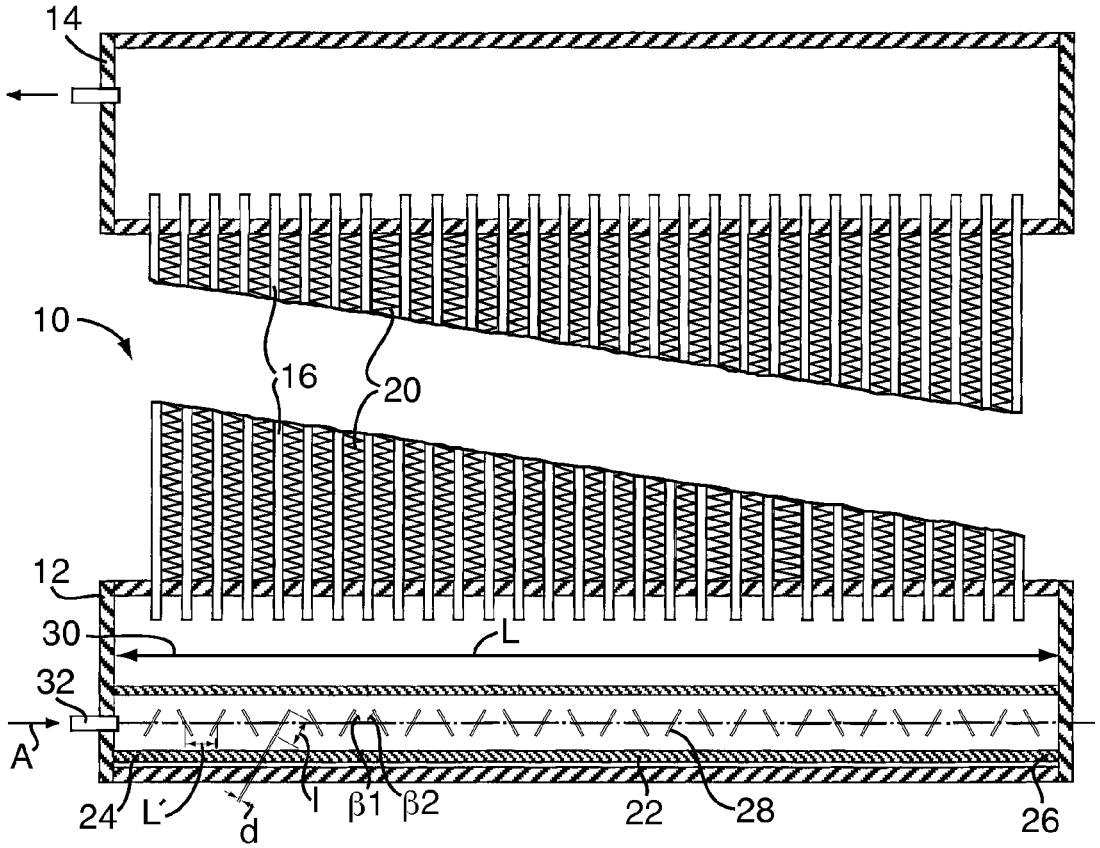
FIG. 2 is a schematic side cross-sectional view of a micro-channel heat exchanger in accordance with an embodiment of the present invention.

FIG. 2 illustrates a heat exchanger design 10 in accordance with the present invention provides improved uniformity, or evenness, of refrigerant fluid distribution and improved efficiency of operation. As illustrated, the heat exchanger 10 is a micro-channel heat exchanger comprising an inlet manifold 12 fluidly connected with an outlet manifold 14 by a plurality of generally parallel tubes 16. The tubes 16 may be flat tubes or circular tubes, and may further be formed to define a plurality of generally parallel micro-channels 18 as more readily seen in FIG. 9. The tubes 16 are connected at both ends to the inlet manifold 12 and the outlet manifold 14, respectively. The connections are sealed so that the micro-channels 18 can communicate with respective interiors of the inlet manifold 12 and the outlet manifold 14 with no risk of refrigerant fluid leaking out of the heat exchanger 10 during operation. A plurality of fins 20 are interposed between adjacent tubes 16, preferably in a zigzagged pattern, to aid in the heat transfer between an airflow passing over the heat exchanger 10 and a refrigerant fluid passing through the heat exchanger 10.

During operation of the heat exchanger 10, refrigerant fluid is introduced to the heat exchanger 10 through a distributor tube 22 disposed within the inlet manifold 12. The distributor tube 22 generally has a first open end 24 connected to a refrigerant source (not shown) and acting as an inlet for the refrigerant fluid flow, a closed second end 26, and a plurality of openings 28 disposed along the length of the distributor tube 22 and acting as an outlet for the refrigerant fluid flow. The refrigerant fluid is discharged from the distributor tube 22 through the openings 28 and into an interior space 30 of the inlet manifold 12. The refrigerant fluid is mixed within the inlet manifold 12 so that the gas-phase refrigerant and the liquid-phase refrigerant are blended evenly without stratification phenomenon. Without the distributor tube 22 in the inlet manifold 12 the refrigerant fluid would separate into a liquid-phase and a gas-phase. A blended refrigerant can efficiently flow from the inlet manifold 12 into and through the tubes 16 without two-phase separation.

The use of openings 28 along the length of the distributor tube 22 aids the blending process within the inlet manifold 12, and also helps distribute the refrigerant fluid to each and every tube 16. Specific features of the distributor tube design that facilitate even dispersal of refrigerant fluid to each of the tubes 16, including the shape, spacing and orientation of the openings 28, are discussed in more detail below.

As refrigerant fluid passes through the tubes 16, an airflow is passed over the surface of the tubes 16 and between the fins 20. The refrigerant fluid absorbs heat from the airflow and evaporates. The resultant heat from this evaporation cools the airflow. The use of the micro-channels 18 increases the efficiency of this heat transfer between the external airflow and the internal refrigerant fluid flow. The evaporated refrigerant is passed to the outlet manifold 14 of the heat exchanger 10, where it can be passed on, for example, to a compressor, or recycled through the system. The cooled airflow is lowered to a temperature suitable for desired cooling applications, such as in air conditioning units, coolers or freezers.

Figure 9:
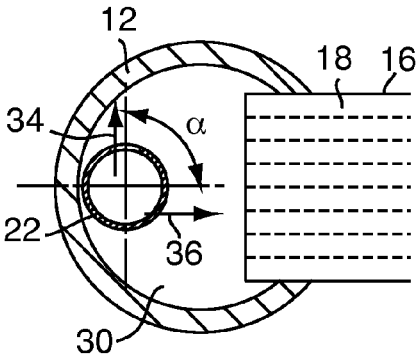
FIG. 9 is a partial cross-sectional view of the micro-channel heat exchanger of FIG. 2 taken along line 9-9.

The distributor tube 22 is preferably a circular tube, as shown in FIGS. 2 and 9. Alternatively, the tube 22 can have a non-circular cross-sectional shape, such as a square or ellipsoid. The refrigerant fluid is introduced to the distributor tube 22 through an inlet 32 along arrow A. The inlet 32 is adapted to be connected to a refrigerant source (not shown). As shown in FIG. 2, the distributor tube 22 has a length L, with openings 28 formed in the surface of the tube 22 along the length L. As illustrated, the openings 28 are aligned along the length L of the tube 22 in a substantially linear arrangement. However, alternate embodiments may include openings 28 arranged at various angular orientations around the circumference of the distributor tube 22. Moreover, the distributor tube 22 can be provided with one or more rows of openings 28. For example, FIGS. 9 and 10 each illustrate a single row of openings 28, while FIG. 11 illustrates a distributor tube 22 having two rows of openings 28*a* and 28*b*.

The distributor tube 22, the openings 28, the tubes 16, the micro-channels 18, and the interior volume of the inlet manifold 12 may be appropriately sized to provide a desired flow rate of refrigerant fluid, a desired refrigerant fluid distribution pattern, and desired mixing conditions in the heat exchanger 10. Certain relationships and ratios between components may be most preferable to meet predetermined performance criteria. For example, a preferred range of ratios between the sum of the areas of the openings 28 and the surface area of the distributor tube 22 is between about 0.01% to about 40%.

Figure 1:
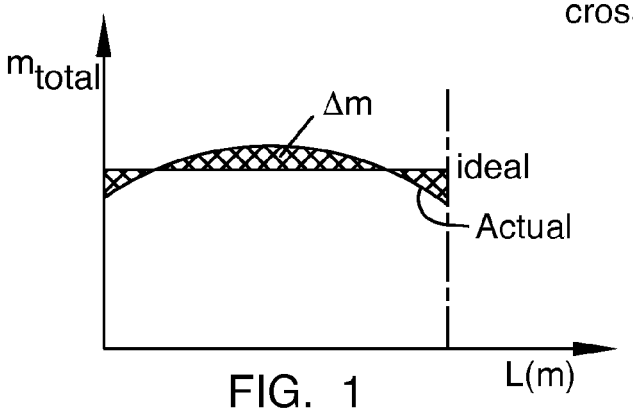
FIG. 1 illustrates the change of refrigerant distribution along the length of a standard prior art distributor tube in a heat exchanger.
Figure 3:
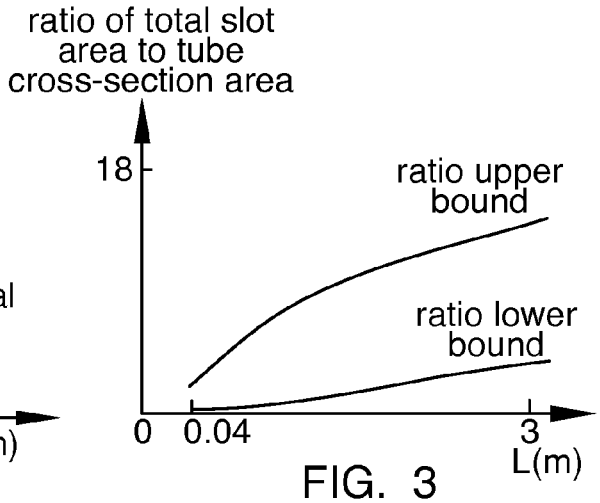
FIG. 3 illustrates a preferred range for the relationship between the distributor tube length (L) and the ratio between the total area of the openings and the cross-sectional area of the distributor tube.

Additionally, tests have shown that the distribution of refrigerant can be improved by balancing the ratio of the total area of the openings 28 to the cross-sectional area of the distributor tube 22 with the distributor tube length L. It has been found that the preferable ratio of total opening area to distributor tube cross-sectional area varies depending on the length L. FIG. 3 illustrates a preferred range for this relationship, where uniformity of refrigerant distribution is at desirable levels if the relationship is designed within the upper and lower bounds shown. More particularly, FIG. 3 shows that for a distributor tube length L in the range of about 0.4 m to about 3 m, the trend of the ratio between total opening area and distributor tube cross-sectional area is between about 0.28 to about 14.4. Moreover, the preferable ratio value and the preferable range of the ratio increase as the length L increases.

Figure 4A:
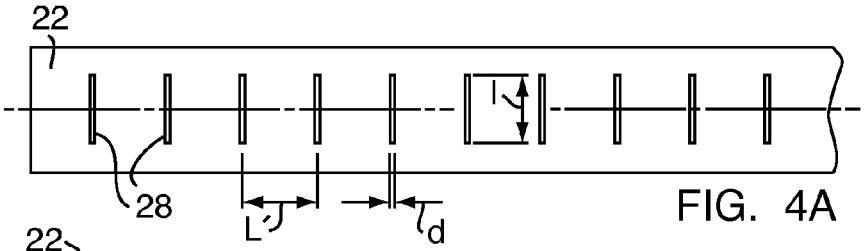
FIGS. 4A-4H depict side views of various alternative distributor tube designs for use in the micro-channel heat exchanger of FIG. 2.
Figure 4B:
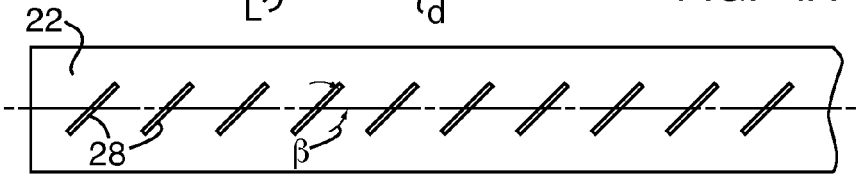
Figure 4C:
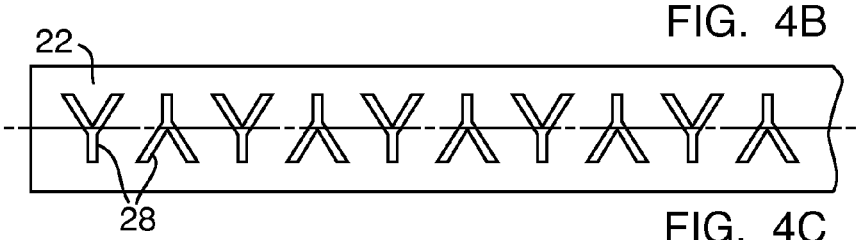
Figure 4D:
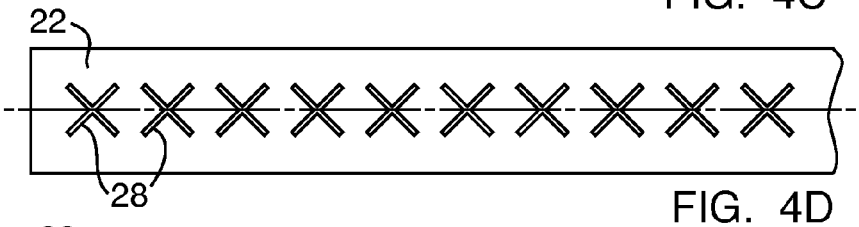
Figure 4E:
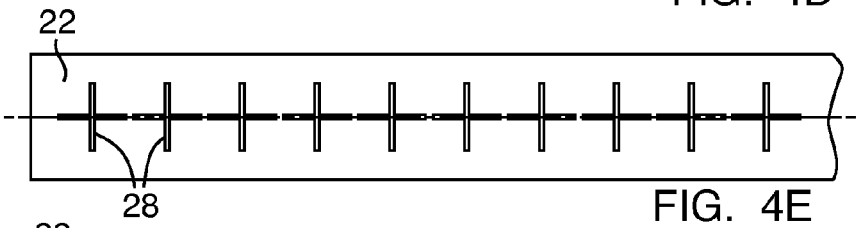
Figure 4F:
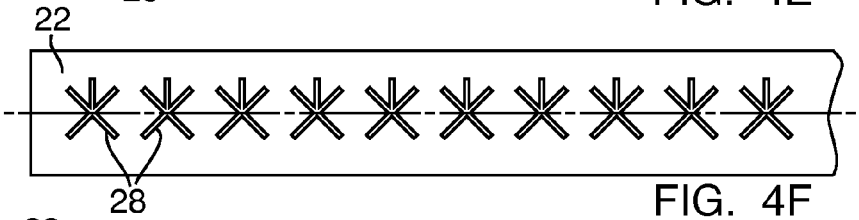
Figure 4G:
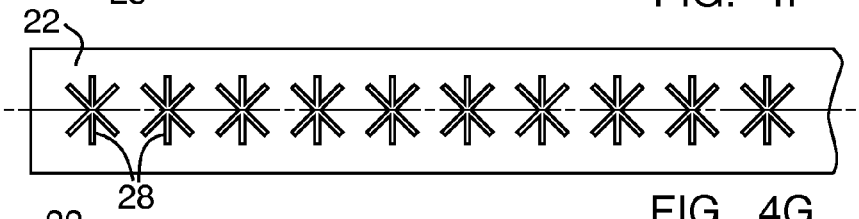
Figure 4H:
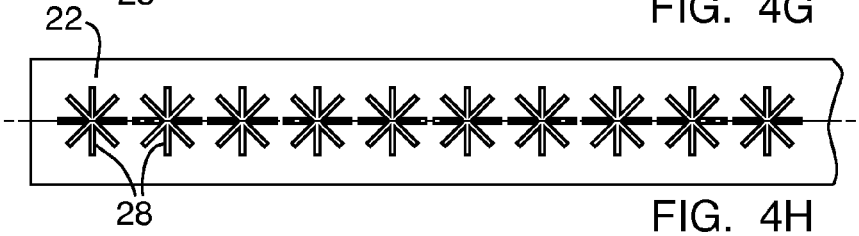

Preferably, the openings 28 have a non-circular shape. More preferably, the openings 28 are slots or elongated openings, as shown in FIGS. 2 and 4A-4B. Alternatively, the openings 28 can be formed by a plurality of intersecting slots extending from a common center, including Y-shaped openings (FIG. 4C), X-shaped openings (FIG. 4D), crisscross-shaped openings (FIG. 4E), and asterisk-shaped openings (FIGS. 4F-4H). Still alternatively, the openings 28 can be triangular, square, rectangular, polygonal or any other non-circular shape.

Figure 5:
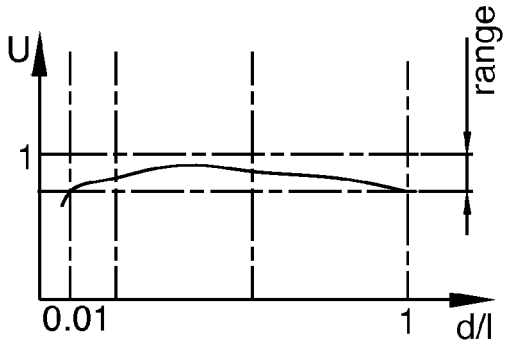
FIG. 5 illustrates the effect of the opening width/length ratio (d/l) on the uniformity of refrigerant distribution.
Figure 6:
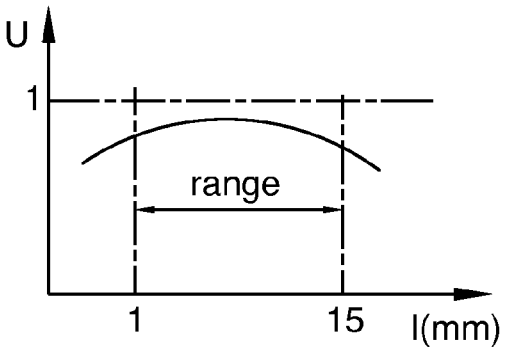
FIG. 6 illustrates the effect of the opening length (l) on the uniformity of refrigerant distribution.

Referring more particularly to FIGS. 2 and 4A-4B, the openings 28 have the form of slots or elongated openings. More specifically, the slots are generally rectangular-shaped having a length l and a width d. In preferred embodiments of the present invention, the openings have a length l in the range of about 1 mm to about 15 mm and a width in the range of about 0.2 mm to about 5 mm. The ratio of width to length (i.e., d/l) is preferably greater than about 0.01 and less than about 1. It has been determined that the use of slots provides a level of uniformity that cannot be obtained using circular openings or even non-circular openings having nominal size relative to comparable circular openings. FIG. 5 illustrates the effect of the width/length ratio (d/l) on the uniformity of refrigerant distribution. Similarly, FIG. 6 illustrates the effect of the slot length (l) on the uniformity of refrigerant distribution.

Figure 7:
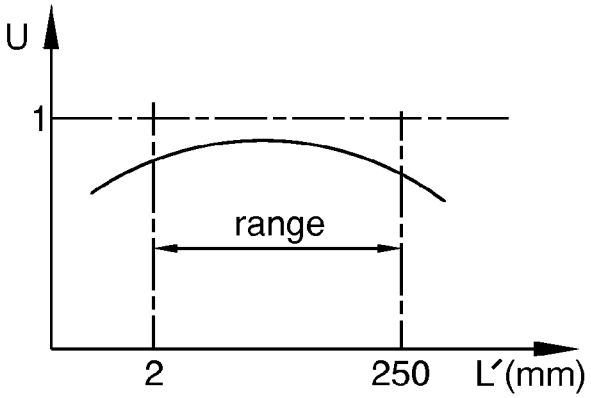
FIG. 7 illustrates the effect of the distance between adjacent openings (L') on the uniformity of refrigerant distribution.

Further improvements in distribution uniformity have been achieved by spacing the slots at optimal distances along the length of the distributor tube 22. As shown in FIG. 2, the geometrical centers of adjacent slots are separated by a distance L'. Preferably, the distance L' is between about 20 mm and about 250 mm. Additionally, a preferable range for the ratio between the distributor tube length L and the distance L', where refrigerant distribution is improved, is between about 2 and about 150. FIG. 7 illustrates the effect of the distance between adjacent slots (L') on the uniformity of refrigerant distribution. If the distance L' is too small, the refrigerant distribution cannot substantially approach uniformity because there are too many openings 28 distributing refrigerant to the inlet manifold 12. Restriction of the refrigerant fluid flow, which aids in mixing and dispersing the refrigerant, is inadequate for desired heat exchanger operation. Conversely, if the distance L' is too large, there will be too few openings 28 to ensure that refrigerant is distributed to each and every tube 16. In general, the tubes 16 in close proximity to an opening 28 will get more refrigerant than tubes 16 located away from an opening 28. Moreover, two-phase refrigerant is more apt to separate into liquid-phase and gas-phase the further it must flow from an opening 28 to a tube 16. Such bi-phase stratification further affects uniformity in a detrimental manner. Accordingly, it has been found that uniformity of refrigerant distribution can be more readily controlled by the spacing of the openings 28 along the length L of the distributor tube 22.

Figure 8:
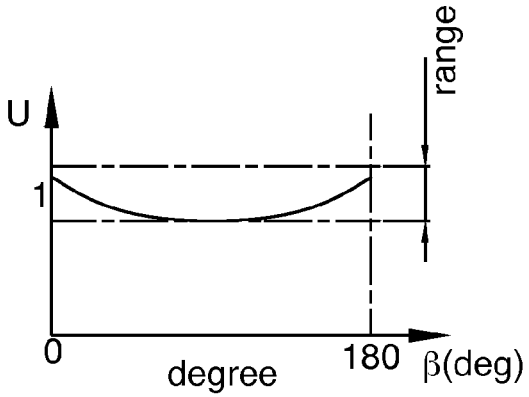
FIG. 8 illustrates the effect of the angular orientation (β) of the opening on the uniformity of refrigerant distribution.

Still further improvements in distribution uniformity have been achieved by angling the longitudinal direction of the slots relative to the longitudinal direction of the distributor tube 22. As depicted in FIG. 4B, the slots are arranged at a first angle β relative to the longitudinal direction of the distributor tube 22. FIG. 8 illustrates the effect of the angular orientation (β) of the slot on the uniformity of refrigerant distribution. As shown, the range for the angle β is between about 0 degrees and 180 degrees. Still further improvement in distribution uniformity has been achieved by disposing the slots along the length of the distributor tube 22 so that adjacent slots are angularly arranged relative to the longitudinal direction of the distributor tube 22 in opposing directions. As depicted in FIG. 2, the slots are angularly arranged where by a first slot is inclined at a first angle $\beta_1$ relative to the longitudinal direction of the distributor tube 22 and a second adjacent slot is inclined at a second angle $\beta_2$ relative to the longitudinal direction of the distributor tube 22. As illustrated, the first angle $\beta_1$ and the second angle $\beta_2$ are equal in magnitude so that two immediately adjacent slots appear as mirror images of one another. However, the angles of adjacent slots can vary between adjacent slots and along the length of the distributor tube 22. As further illustrated, the slots define an elongated length and a truncated length such that pairs of slot are arranged to substantially mirror each other with respect to a plane normal to the central axis of the distributor tube.

Figure 10:
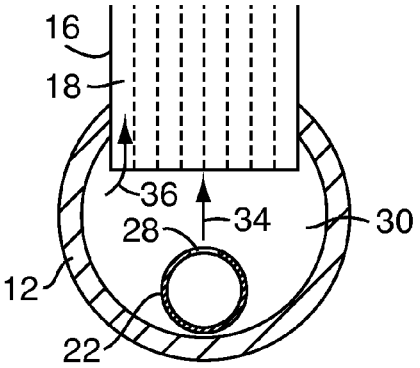
FIG. 10 is a partial cross-sectional view of a micro-channel heat exchanger in accordance with another embodiment of the present invention.
Figure 11:
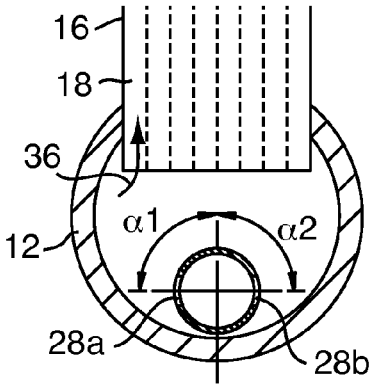
FIG. 11 is a partial cross-sectional view of a micro-channel heat exchanger in accordance with another embodiment of the present invention.

Referring to FIG. 10, a partial cross-sectional view of the micro-channel heat exchanger 10 in accordance with the present invention is shown. In particular, the distributor tube 22 is shown disposed within the interior space 30 of the inlet manifold 12 such that the openings 28 are directed towards the inlets of the micro-channels 18 of the tubes 16. In operation, refrigerant fluid is discharged from the distributor tube 22 into the interior space 30 of the inlet manifold 12 through openings 28. The refrigerant fluid is typically mixed within the interior space 30 and then distributed into and through the micro-channels 18 of the tubes 16. The direction of refrigerant fluid flow out of the openings 28, as represented by arrow 34, is in substantially the same direction as the general refrigerant fluid flow into and through the tubes 16, as represented by arrow 36. In general, the direction of refrigerant fluid flow into and through the tubes 16 is the axial direction of the tubes 16.

The direction of the refrigerant fluid flow out of the openings 28 does not need to be in the same general direction as the refrigerant fluid flow into and through the tubes 16. Indeed, orienting the openings 28 at an angle relative to the direction of the tubes 16 may promote mixing of the refrigerant fluid within the interior space 30 of the inlet manifold 12. Referring to FIG. 9, angle $\alpha$ represents the angle between the direction of refrigerant fluid flow out of the openings 28, as represented by arrow 34, and the general direction of refrigerant fluid flow through the tubes 16, as represented by arrow 36. In accordance with embodiments of the present invention for a single row of openings 28, the angle $\alpha$ may be in the range of greater than 0 degrees and less than or equal to 360 degrees. In some embodiments, the openings 28 may be oriented at an angle $\alpha$ in the range of greater than or equal to about 90 degrees and less than or equal to about 270 degrees. As illustrated in FIG. 9, the row of openings 28 is oriented at about 90 degrees.

Referring to FIG. 11, a partial cross-sectional view of the micro-channel heat exchanger 10 using a distributor tube 22 having two rows of openings 28*a* and 28*b* is shown. For two rows of openings, the direction of the openings has less influence on the uniformity of distribution than for a single row of openings. A first row of openings 28*a* may generally be oriented at an angle $\alpha_1$ in the range of greater than 0 degrees to less than or equal to 180 degrees. A second row of openings 28*b* may generally be oriented at an angle $\alpha_2$ in the range of greater than or equal to 180 degrees and less than 360 degrees. The angles $\alpha_1$ and $\alpha_2$ are preferably equal in magnitude, though they need not be. As illustrated, each of the rows of openings 28*a* and 28*b* are oriented at approximately 90 degree angles relative to the general direction of the refrigerant fluid flow through the tubes 16.

Figure 12:
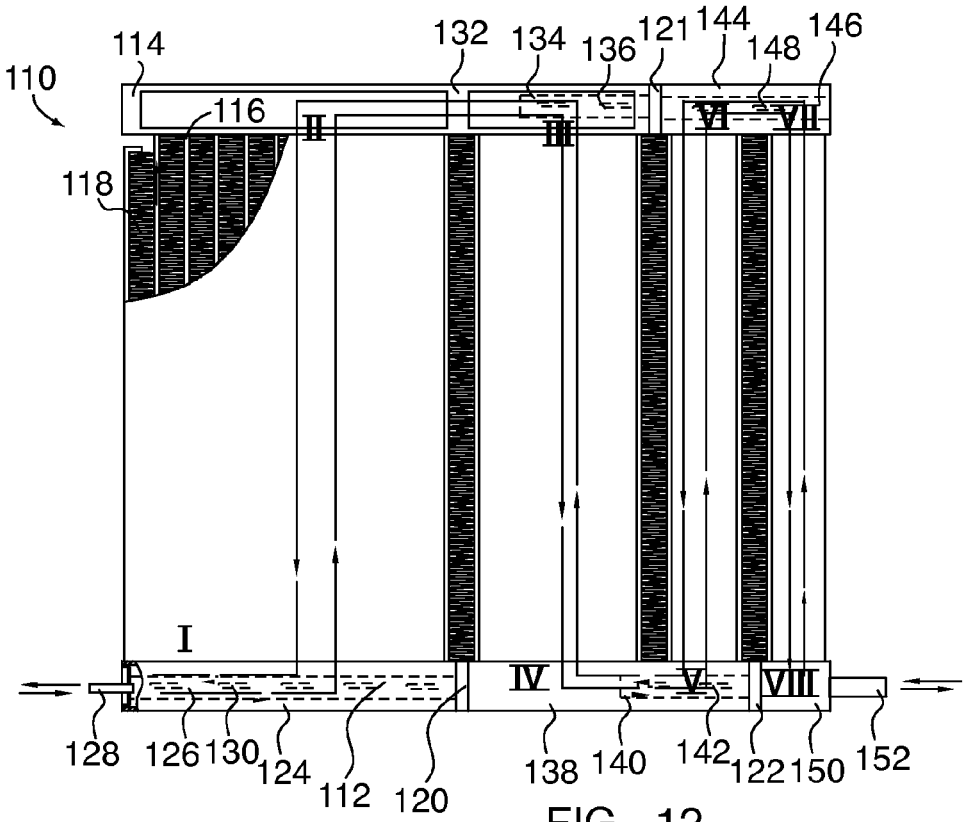
FIG. 12 is a schematic side view of a micro-channel heat exchanger is accordance with an alternate embodiment of the present invention.

Referring to FIG. 12, an alternative heat exchanger 110 is provided. The heat exchanger 110 includes structure much like the heat exchanger 10 shown in FIG. 2. Specifically, heat exchanger 110 includes a first manifold 112 fluidly connected with a second manifold 114 by a plurality of generally parallel tubes 116, each preferably comprising a plurality of generally parallel micro-channels (not shown). A plurality of fins 118 are interposed between adjacent tubes 116, preferably in a zigzagged pattern, to aid in the heat transfer between an airflow passing over the heat exchanger 110 and a refrigerant fluid passing through the heat exchanger 110.

The heat exchanger 110 can be designed to have a plurality of flow paths through the heat exchanger 110. Such an exchanger may be useful for applications requiring a long cooling device. Typically, uniformity of refrigerant distribution is difficult to achieve and maintain when the lengths of the manifolds increase. One solution previously used in such situations has been to provide a plurality of heat exchangers in a fluid parallel assembly, such as illustrated in U.S. Pat. No. 7,143,605. Such a system, however, increases the number of connections that must be checked to ensure proper operation of the system.

In accordance with the present invention, multiple flow paths through the heat exchanger 110 can be created by providing partitions in one or both of the first manifold 112 and the second manifold 114. The partitions divide the manifolds into multiple chambers. As shown in FIG. 12, the first manifold 112 is divided into three chambers using two partitions 120 and 122. The second manifold 114 is divided into two chambers using a single partition 121. As so designed, the heat exchanger 110 includes multiple flow paths that snake back and forth between the first manifold 112 and the second manifold 114.

Refrigerant flow through the heat exchanger 110 is represented in FIG. 12 by arrows. As illustrated, a first chamber 124 of the first manifold 112, defined at one end by the inlet of the first manifold 112 and at the other end by partition 120, receives a first distributor tube 126 having a first open end comprising an inlet 128 for the refrigerant fluid flow, a closed second end, and a plurality of openings 130 disposed along the length of the first distributor tube 126 and acting as an outlet for the refrigerant fluid flow. The openings 130 may be slots or other non-circular shapes as described above and shown in FIGS. 2 and 4A-4H. The refrigerant fluid is discharged from the first distributor tube 126 through the openings 130 and into the interior space of the first manifold chamber 112 where it is mixed. The first chamber 124 acts as a first zone I for the refrigerant flow. The refrigerant passes from this zone and into and through the tubes 116. The refrigerant is discharged into a first chamber 132 of the second manifold 114.

The first chamber 132 of the second manifold 114, defined at one end by a closed end of the second manifold 114 and at the other end by partition 121, is generally longer than the first chamber 124 of the first manifold 112, and is essentially divisible into a second zone II and a third zone III. The second zone II is generally aligned with and has the same size as the first zone I. The second zone II acts as an outlet manifold and receives refrigerant flow from the tubes 116. The third zone III acts as an inlet manifold and receives and distributes refrigerant flow discharged from the second zone II. A second distributor tube 134 having openings 136 may be disposed in the third zone III for even distribution of refrigerant flow to the tubes 116. Refrigerant then flows from the second manifold 114 through the tubes 116 back to the first manifold 112, where the refrigerant flow is discharged into a second chamber 138 of the first manifold 112.

The second chamber 138 of the first manifold 112 is longitudinally defined by partitions 120 and 122, and is essentially divisible into a fourth zone IV and a fifth zone V. The fourth zone IV is generally aligned with and has the same size as the third zone III. The fourth zone IV acts as an outlet manifold and receives refrigerant flow from the tubes 116. The fifth zone V acts as an inlet manifold and receives and distributes refrigerant flow from discharged from the fourth zone IV. A third distributor tube 140 having openings 142 may be disposed in the fifth zone V for even distribution of refrigerant flow to the tubes 116. Refrigerant then flows from the first manifold 112 through the tubes 116 back to the second manifold 114, where the refrigerant flow is discharged into a second chamber 144 of the second manifold 114.

The second chamber 144 of the second manifold 114 is longitudinally defined by partition 121 on one end and a closed end of the second manifold 114, and is essentially divisible into a sixth zone VI and a seventh zone VII. The sixth zone VI is generally aligned with and has the same size as the fifth zone V. The sixth zone VI acts as an outlet manifold and receives refrigerant flow from the tubes 116. The seventh zone VII acts as an inlet manifold and receives and distributes refrigerant flow from discharged from the sixth zone VI. A fourth distributor tube 146 having openings 148 may be disposed in the seventh zone VII for even distribution of refrigerant flow to the tubes 116. Refrigerant then flows from the second manifold 114 through the tubes 116 back to the first manifold 112, where the refrigerant flow is discharged into a third chamber 150 of the first manifold 112.

The third chamber 150 of the first manifold 112 is longitudinally defined by partition 122 on one end and an outlet 152 of the first manifold 112 on the other end. The third chamber 150 is essentially an eighth zone VIII that is generally aligned with and has the same size as the seventh zone VII. The eighth zone VIII acts as an outlet manifold and receives refrigerant flow from the tubes 116 and discharges the refrigerant from the heat exchanger 110.

In the above-described embodiment of heat exchanger 110, as the size of the distributor tubes decrease, the area of the openings therein generally increase so as to account for a decrease flow rate of the refrigerant and an increased flow resistance in the tubes 116.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A distributor tube for use in a heat exchanger having an inlet manifold fluidly connected to an outlet manifold by a plurality of generally parallel tubes, said distributor tube comprising:

a first open end adapted for communication with a refrigerant source;

an opposing second closed end; and a plurality of non-circular openings disposed in a row along the length of the distributor tube between the first end and the second end;

wherein each of the plurality of openings is a slot having an elongated length, a truncated length, and a longitudinal direction, the longitudinal direction extending in the direction of the elongated length of the slot, the longitudinal direction of each slot being angularly arranged at an acute angle relative to a plane that extends along a central axis of the distributor tube and through the center of the openings, where the plurality of non-circular openings are arranged in a plurality of pairs of non-circular openings such that the non-circular openings in each pair are arranged to substantially mirror each other with respect to a plane normal to the central axis of the distributor tube.

2. The distributor tube of claim 1, wherein adjacent slots are angularly arranged relative to the plane in opposing directions.

3. The distributor tube of claim 2, wherein the acute angles of adjacent slots relative to the plane are generally identical.

4. The distributor tube of claim 1, wherein each of the slots has a length l in the range of 1 mm ≤l ≤15 mm.

5. The distributor tube of claim 1, wherein each of the slots has a width d in the range of 0.2 mm ≤d ≤5 mm.

6. The distributor tube of claim 1, wherein the geometrical center of adjacent openings are separated by a distance in the range of about 20 mm to about 250 mm.

7. The distributor tube of claim 1, wherein a ratio between a sum of areas of the openings and a cross-sectional area of the distributor tube has a direct relationship to a length of the distributor tube such that the ratio increases as the distributor tube length increases.

8. A micro-channel heat exchanger comprising:

an inlet manifold;

an outlet manifold spaced a predetermined distance from the inlet manifold;

a plurality of tubes, the opposing ends of which are connected with the inlet manifold and the outlet manifold, respectively, to fluidly connect the inlet manifold and the outlet manifold, each tube including a plurality of generally parallel micro-channels formed therein; and a distributor tube disposed within the inlet manifold and having a first open end adapted to be connected to a refrigerant source and an opposing second closed end, said distributor tube including a plurality of non-circular openings disposed in a row along the length of the distributor tube;

wherein each of the plurality of openings is a slot having an elongated length, a truncated length, and a longitudinal direction, the longitudinal direction extending in the direction of the elongated length of the slot, the longitudinal direction of each slot being angularly arranged at an acute angle relative to a plane that extends along a central axis of the distributor tube and through the center of the openings, where the plurality of non-circular openings are arranged in a plurality of pairs of non-circular openings such that the non-circular openings in each pair are arranged to substantially mirror each other with respect to a plane normal to the central axis of the distributor tube.

9. The micro-channel heat exchanger of claim 8, wherein adjacent slots are angularly arranged relative to the plane in opposing directions.

10. The micro-channel heat exchanger of claim 9, wherein the acute angles of adjacent slots relative to the plane are generally identical.

11. The micro-channel heat exchanger of claim 8, wherein each of the slots has a length l in the range of 1 mm ≤l ≤15 mm.

12. The micro-channel heat exchanger of claim 8, wherein each of the slots has a width d in the range of 0.2 mm ≤d ≤5 mm.

13. The micro-channel heat exchanger of claim 8, wherein the geometrical center of adjacent openings are separated by a distance in the range of about 20 mm to about 250 mm.

14. The micro-channel heat exchanger of claim 8, wherein a ratio between a sum of areas of the openings and a cross-sectional area of the distributor tube has a direct relationship to a length of the distributor tube such that the ratio increases as the distributor tube length increases.

15. The micro-channel heat exchanger of claim 8, wherein the plurality of openings are arranged in a substantially linear row along the length of the distributor tube, and further wherein the row of openings is oriented within the inlet manifold so that a general direction of a refrigerant flow out of the openings is at an angle relative to a general direction of a refrigerant flow through the tubes.

16. The micro-channel heat exchanger of claim 15, wherein the angle is in the range of greater than or equal to about 90 degrees and less than or equal to about 270 degrees.

17. The micro-channel heat exchanger of claim 8, wherein the distributor tube comprise two substantially linear rows of non-circular openings along the length of the distributor tube, wherein the orientation of the general direction of refrigerant flow out of a first row of openings relative to the general direction of refrigerant flow through the tubes is at an angle in the range of greater than 0 degrees and less than or equal to about 180 degrees; and wherein the orientation of the general direction of refrigerant flow out of a second row of openings relative to the general direction of refrigerant flow through the tubes is at an angle in the range of greater than or equal to about 180 degrees and less than 360 degrees.

18. A distributor tube for use in a heat exchanger having an inlet manifold fluidly connected to an outlet manifold by a plurality of generally parallel tubes, said distributor tube comprising:

a first open end adapted for communication with a refrigerant source;

an opposing second closed end; and a plurality of slotted openings disposed in a row along the length of the distributor tube between the first end and the second end;

wherein each of the slotted openings has an elongated length, a truncated length, and a longitudinal direction, the longitudinal direction extending in the direction of the elongated length of the slot, the longitudinal direction of each slot being angularly arranged at a non-ninety degree angle relative to a plane that extends along a central axis of the distributor tube and through the center of the openings, wherein the plurality of slotted openings are arranged in a plurality of pairs of slotted openings such that the slotted openings in each pair are arranged to substantially mirror each other with respect to a plane normal to the central axis of the distributor tube.

* * * * *

UNITED STATES PATENT AND TRADEMARK OFFICE

CERTIFICATE OF CORRECTION

PATENT NO. : 9,291,407 B2
APPLICATION NO. : 12/535504
DATED : March 22, 2016
INVENTOR(S) : Liu Huazhao, Jiang Jianlong and Lin-Jie Huang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 921 days.

Signed and Sealed this
Twenty-sixth Day of July, 2016

Michelle K. Lee

Michelle K. Lee
*Director of the United States Patent and Trademark Office*